US011702259B2

(12) United States Patent
Stallard

(10) Patent No.: US 11,702,259 B2
(45) Date of Patent: Jul. 18, 2023

(54) INFANT FORMULA PREPARATION APPARATUS

(71) Applicant: Bottletech Pty Ltd, Bulimba (AU)

(72) Inventor: Cameron Walter Jack Stallard, Bulimba (AU)

(73) Assignee: Bottletech Pty Ltd, Queensland (AU)

( * ) Notice: Subject to any disclaimer, the term of this patent is extended or adjusted under 35 U.S.C. 154(b) by 0 days.

(21) Appl. No.: 16/842,437

(22) Filed: Apr. 7, 2020

(65) Prior Publication Data

US 2020/0385184 A1 Dec. 10, 2020

(51) Int. Cl.

| | |
|---|---|
| ***B65D 51/28*** | (2006.01) |
| ***B65D 51/22*** | (2006.01) |
| ***B65D 81/32*** | (2006.01) |

(52) U.S. Cl.

CPC ..... *B65D 51/2835* (2013.01); *B65D 51/228* (2013.01); *B65D 51/2821* (2013.01); *B65D 51/2864* (2013.01); *B65D 81/3211* (2013.01); *B65D 2251/0093* (2013.01)

(58) Field of Classification Search

CPC ..... B65D 51/228; B65D 51/2821; B65D 51/2864; B65D 81/3211; B65D 2251/0093

USPC ..... 206/219, 222

See application file for complete search history.

(56) References Cited

U.S. PATENT DOCUMENTS

| | | | | |
|---|---|---|---|---|
| 8,403,131 | B2 * | 3/2013 | Rovelli | B65D 51/2835 206/222 |
| 2008/0314775 | A1 | 12/2008 | Owoc | |
| 2015/0321142 | A1 * | 11/2015 | Lebon | B65D 41/3447 220/608 |

FOREIGN PATENT DOCUMENTS

| | | | |
|---|---|---|---|
| CN | 109823682 | A | 5/2019 |
| GB | 2566983 | A | 4/2019 |
| JP | 2015105108 | A | 6/2015 |
| WO | 03/106292 | A1 | 12/2003 |
| WO | 2014/205618 | A1 | 12/2014 |

OTHER PUBLICATIONS

Extended European Search Report for related European Application No. 20160463.4 dated Jan. 28, 2021.

Examination Report for corresponding Australian Application No. 2020200265 dated Feb. 7, 2020.

International Search Report for related International Application No. PCT/AU2020/050564, dated Jul. 1, 2020.

International Preliminary Report on Patentability for related International Application No. PCT/AU2020/050564, dated Dec. 7, 2021.

* cited by examiner

*Primary Examiner* — Steven A. Reynolds

(74) *Attorney, Agent, or Firm* — Renner, Otto, Boisselle & Sklar, LLP

(57) ABSTRACT

An assembly for dispensing a substance into a receptacle, the assembly including: a) a first portion connected to an opening of the receptacle; b) a chamber for containing the substance, the chamber being at least partly located within the first portion; c) a seal located below the chamber, the seal retaining the substance in the chamber; d) a removable stop member; and wherein removal of the stop member enables the chamber to be moved downwardly to cause the seal to open and release the substance into the receptacle.

11 Claims, 12 Drawing Sheets

DETAIL D - LOCK

INFANT FORMULA PREPARATION APPARATUS

RELATED APPLICATION DATA

This application claims the benefit of Australian Patent Application No. 2020200265, filed Jan. 14, 2020, and claims the benefit of Australian Provisional Patent Application No. 2019901951, filed Jun. 5, 2019, the disclosures of which are incorporated herein by reference in their entireties.

FIELD

The present invention relates to an assembly for dispensing a substance into a receptacle. In particular, the present invention relates to an assembly for dispensing infant formula into a feeding bottle.

BACKGROUND

Baby bottles are widely used by parents and caretakers to feed their children. Most commonly, baby bottles are used to feed infant formula to babies or young children. The process to prepare a bottle of infant formula would involve measuring an amount of infant formula, placing it into the bottle, adding water and mixing the contents together. Even though this process appears to be relatively straightforward, preparing a bottle of infant formula can be quite stressful especially when the baby is crying. This process becomes more difficult when the parents are travelling with the baby and the bottle of infant formula is prepared outside the comfort of a home.

Traditionally, when the parents are travelling with the baby, the parents would pre-measure an amount of infant formula in a container and take it outdoors with them so that they can pour the infant formula into the baby bottle and mix with water when feeding it to the baby. However, this process is time consuming and laborious.

Numerous devices have been disclosed for storing a powder within a bottle until ready for consumption. For example, the bottle may comprise an inner tube that contains a substance (liquid or powder) to be kept separate from the substance in the bottle prior to use. In use, the user will unscrew the cap of the bottle and pull the inner tube upwards which detaches the inner tube from the base of the bottle and permitting the substances to mix. Whilst this bottle provides a method to mix two substances together, the bottle is not configured for use with infant formula powders nor suitable for use with babies or young children.

It will be clearly understood that, if a prior art publication is referred to herein, this reference does not constitute an admission that the publication forms part of the common general knowledge in the art in Australia or in any other country.

SUMMARY OF INVENTION

The present invention is directed to an assembly for dispensing a substance into a receptacle, which may at least partially overcome at least one of the abovementioned disadvantages or provide the consumer with a useful or commercial choice.

With the foregoing in view, the present invention in one form, resides broadly in an assembly for dispensing a substance into a receptacle, the assembly comprising:

a) a first portion connected to an opening of the receptacle;

b) a chamber for containing the substance, the chamber being at least partly located within the first portion;

c) a seal located below the chamber, the seal retaining the substance in the chamber;

d) a removable stop member; and wherein removal of the stop member enables the chamber to be moved downwardly to cause the seal to open and release the substance into the receptacle.

In one embodiment, the first portion comprises a flange to support the removable stop member.

In one embodiment, the first portion further comprises an inner wall with a plurality of angular protrusions.

In one embodiment, the first portion further comprises internal threads, the internal threads connected to external threads of the opening of the receptacle.

In one embodiment, the stop member comprises a removable ring or strip. In one embodiment, the stop member forms a tamper-evident ring or strip.

In one embodiment, a threaded collar is located above the removable stop member.

In one embodiment, the threaded collar has internal threads that are connected to external threads of the chamber.

In one embodiment, the chamber comprises a spoke to support the substance or to provide enhanced strength to the chamber.

In one embodiment, the substance is a baby formula powder.

In one embodiment, the chamber includes an upper flange and a lower flange, the lower flange abutting the plurality of angular protrusions of the first portion.

In one embodiment, a circular ring rests between the flange of the first portion and the lower flange of the chamber.

In one embodiment, one end of the chamber is slanted in a downwardly direction and configured to come in contact with a portion of the seal.

In one embodiment, the seal comprises a tab.

In one embodiment, the tab rests between a wall of the receptacle and the first portion.

In one embodiment, the seal is made of a plastic material.

In one embodiment, the assembly further comprises a mouth portion such as a teat.

In one embodiment, the assembly comprises a lid to protect the mouth portion.

In one embodiment, the receptacle contains a liquid.

In one embodiment, the liquid may be water.

In one embodiment, the assembly further includes an external ring located below the first portion.

In a second embodiment of the invention, there is provided an assembly for dispensing a substance into a receptacle, the assembly comprising:

a) a first portion connected to an opening of the receptacle;

b) a chamber for containing the substance, the chamber being at least partially located within the first portion;

c) a seal located below the chamber, the seal retaining the substance in the chamber;

d) a second portion located above the first portion;

e) a chamber cutter, the chamber cutter being at least partially located within the first portion and second portion;

f) a removable member; and wherein removal of the removable member enables the chamber cutter to be moved downwardly to cause the seal to open and release the substance into the receptacle.

In one embodiment, the first portion comprises a flange to support the second portion.

In one embodiment, the second portion is adapted to support the removable member prior to the release of the substance, and a third portion after the release of the substance.

In one embodiment, the third portion is located above the removable member.

In one embodiment, the third portion connects to a mouth portion, such as a teat.

In one embodiment, the chamber cutter includes a spoke for structural support.

In one embodiment, one end of the chamber cutter is slanted in a downward direction and configured to come in contact with a portion of the seal.

In one embodiment, a circular seal rests between the chamber and the first portion.

In one embodiment, the seal further includes a tab.

In one embodiment, the tab rests between a wall of the receptacle and the first portion.

In one embodiment, the seal is made of a plastic or foil material.

In one embodiment, the second portion further includes a vertical lip to engage with the third portion.

In one embodiment, the chamber further includes a lateral shoulder to engage with the first portion.

In one embodiment, the assembly further comprises a lid to protect a mouth portion.

In one embodiment, the receptacle contains a liquid.

In one embodiment, the liquid is water.

In one embodiment, the substance is baby formula powder.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DESCRIPTION OF EMBODIMENTS

According to a first embodiment of the present invention, there is provided an assembly for dispensing a substance into a receptacle 100 as shown in FIGS. 1 to 4A.

Figure 1:
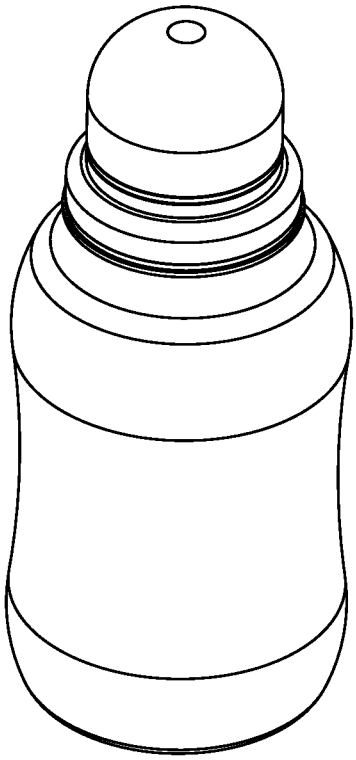
FIG. 1 is an isometric view of the assembly for dispensing a substance into the receptacle according to one embodiment of the present invention.
Figure 2:
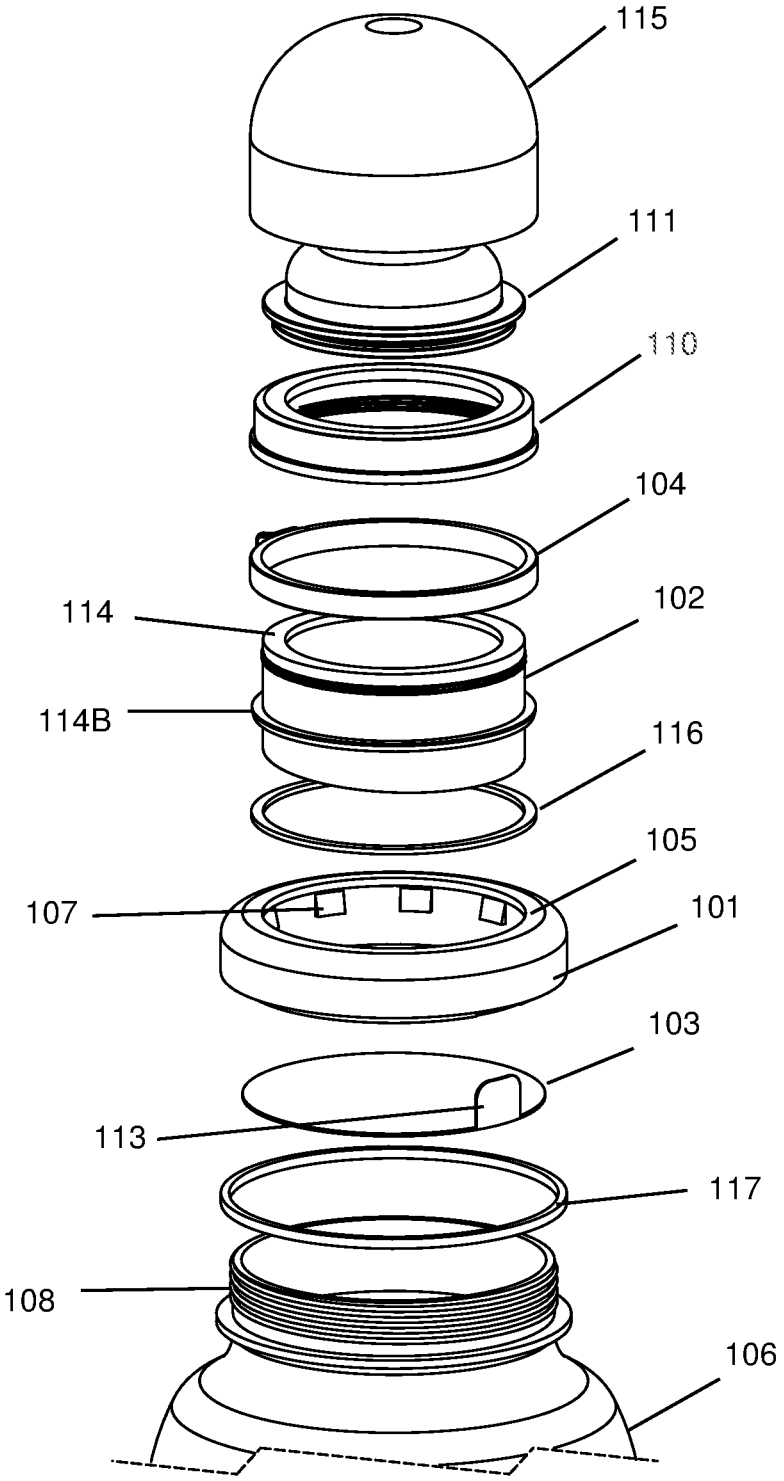
FIG. 2 is an exploded perspective view of the assembly as shown in FIG. 1.
Figure 3:
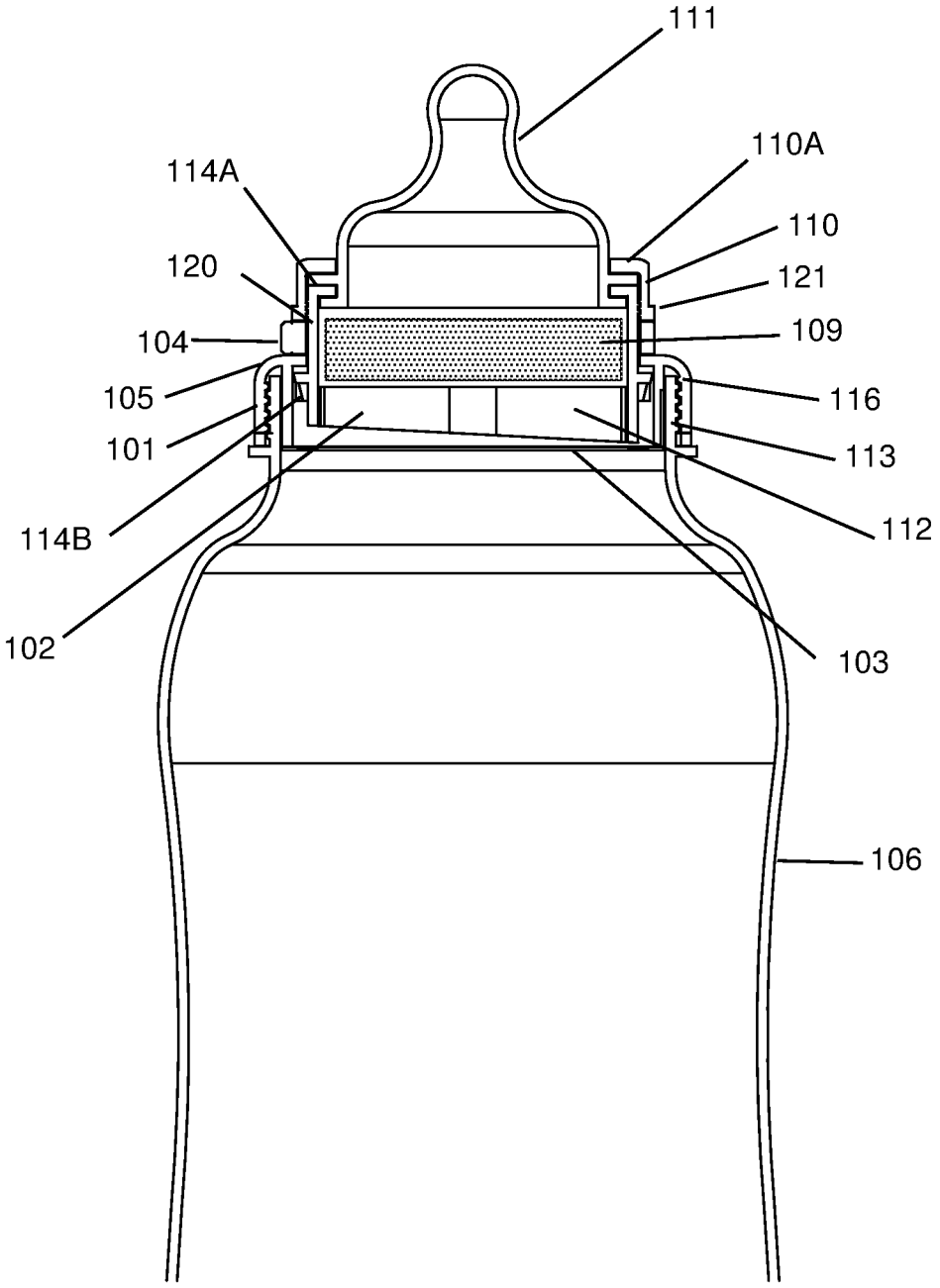
FIG. 3 is a frontal cross-sectional view of the assembly in the configuration before the baby formula is released into the bottle.
Figure 4:
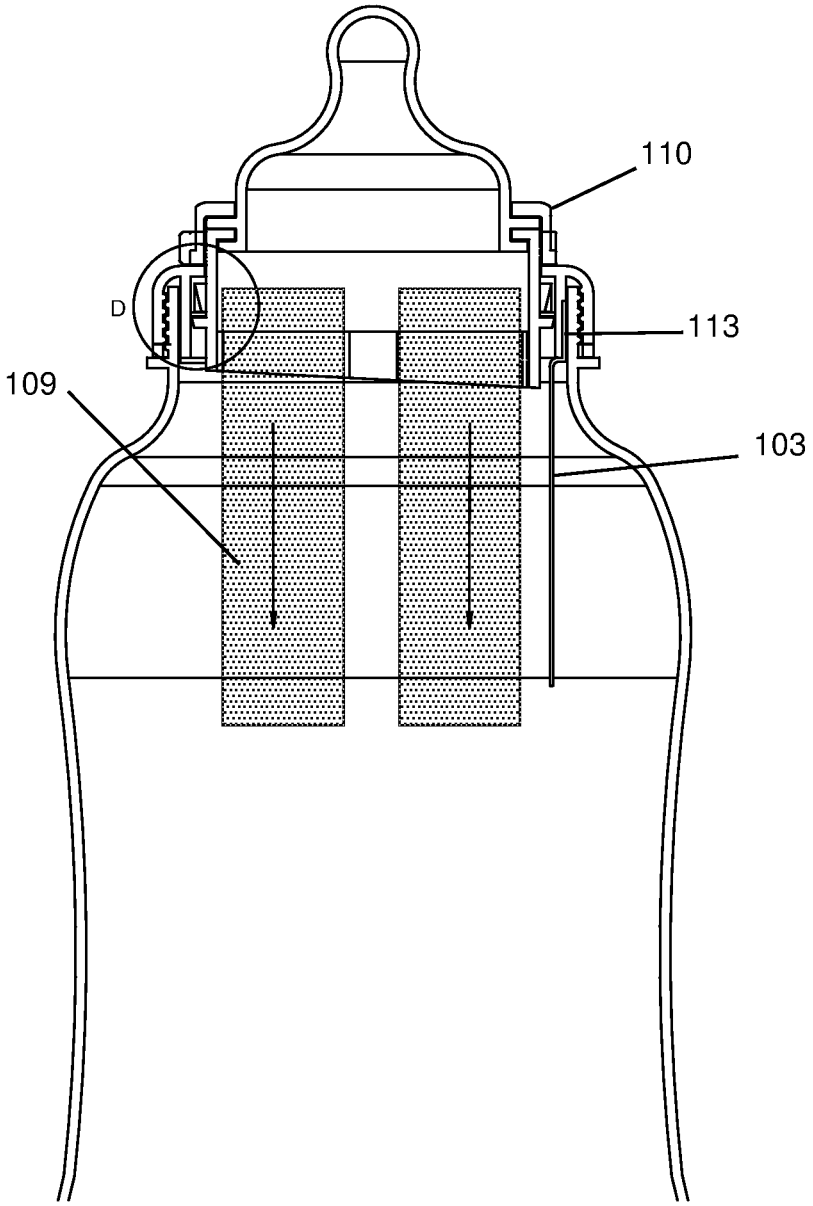
FIG. 4 is a frontal cross-sectional view of the assembly in the configuration after the baby formula is released into the bottle.
Figure 4A:
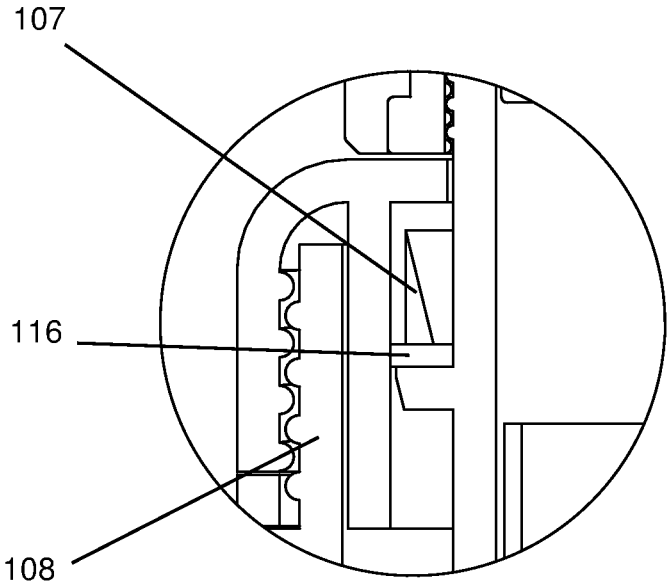
FIG. 4A is a close up view of detail D as shown in FIG. 4.

With reference to FIGS. 2 to 4, the assembly 100 is comprised of a number of components including a first portion 101, a chamber 102, a seal 103 and a removable stop member 104. As illustrated in the drawings, the first portion 101 is connected to the opening of the receptacle 106 by way of a threaded connection. The first portion has internal threads which are configured to connect with the external threads 108 of the receptacle 106. An inwardly extending flange 105 is formed at the top of the first portion 101 to support the removable stop member 104 (as shown in FIG. 3). The first portion further comprises an inner wall with a plurality of angular protrusions 107 which enables the chamber to lock in place when the chamber is moved in a downwardly direction upon force or pressure by the user. This can be seen in a close up view in FIG. 4A.

The chamber 102 contains a substance 109. In a preferred embodiment, the substance is preferably an infant formula powder, although it is envisaged that other forms of beverage powders can be stored in the chamber. As shown in FIGS. 3 and 4, the chamber 102 is partly located within the first portion 101. The chamber 102 has an inwardly extending upper flange 114A and the upper part of chamber 102 is connected to a threaded collar 110. A mouth portion 111 in the form of a teat has a lower flange that is sandwiched between flange 114A and the inwardly extending flange 110A of collar 110. The chamber 102 also has a lower flange 114B which is configured to abut with the plurality of angular protrusions 107 of the first portion 101. On one end of the chamber relative to the seal 103, the chamber is slanted in a downwardly direction so that upon force or pressure by the user, the slanted end of the chamber 112 will come into contact with a portion of the seal 103. A spoke (not shown in the drawings) may be located inside the chamber to provide structural support for the substance 109.

As shown in FIGS. 2 and 3, the seal 103 is located below the first portion 101 and acts as a barrier between the chamber 102 and the lower portion of the receptacle 106. The seal may be glued or heat sealed to the bottom edge of the chamber, as will be known to persons skilled in the art. The seal 103 includes a tab 113 which is positioned between a wall of the receptacle 106 and the first portion 101. This acts to retain the tab 113 in that position even when the seal has been opened. The seal can be made of any material that provides a moisture barrier. However, it is preferred that the seal is made of a plastic material.

Returning to the chamber 102 in FIG. 3, the chamber 102 comprises external threads 120 to connect with internal threads 121 of the threaded collar 110. The threaded collar 110 is adapted to engage with a mouth portion 111 such as a teat or nipple. Prior to use and before the substance 109 is released into the receptacle 106, the threaded collar 110 is positioned above the removable stop member 104. As the removable stop member 104 is effectively located in the gap between the lower end of threaded collar 110 and first portion 101, downward movement of the threaded collar 110 relative to the first portion 101 is not possible. As a result, the chamber is effectively held or locked in the position shown in FIG. 3 whilst the removable stop member 104 is in place, thereby preventing delivery of the substance 109 form the chamber into the receptacle 106.

In order to deliver the substance 109 into the receptacle 106, the removable stop member 104 is removed and this creates a space between the threaded collar 110 and first portion 101. The space enables the user to push the threaded collar 110 in a downwardly direction onto the first portion 101. The user may also rotate the threaded collar during downward pushing to facilitate the downward movement. In a preferred embodiment, the removable stop member functions as a tamper ring.

The assembly 100 also has a circular ring 116 disposed between the flange of the first portion 101 and the lower flange of the chamber 114B. This circular ring 116 may act as an internal seal to prevent spillage or leakage of the liquid in the receptacle 106. A further external ring 117 is located below the first portion 101. The external ring 117 is configured to act as an outer seal of the assembly 100 against the receptacle 106.

In operation, the user will remove the removable stop member 104 from the assembly 100. The user will push the threaded collar 110 downwardly towards and onto the flange of the first portion 101, thereby moving the chamber 102 in a downwardly direction. As the chamber is moved in a downwardly direction, this causes the slanted end of the chamber 112 to come into contact with a portion of the seal 103 which will cause the seal to open and release the substance 109 into the receptacle 106 (as shown in FIG. 4). The tab 113 of the seal retains the seal and stops the seal becoming free to drop into the liquid in the receptacle. The user will then mix the substance (e.g. infant formula powder) with the substance inside the receptacle (e.g. water) until the substances are combined. Once the substances are combined, the user will remove the protective lid 115 to feed the infant formula to the baby. If desired, the user can microwave or warm the substance in the receptacle to an appropriate temperature before feeding the baby.

A second embodiment of the present invention will be described with reference to FIGS. 5 to 11. The fundamental configuration of the apparatus of the further embodiment is similar to the embodiment described above.

Figure 5:
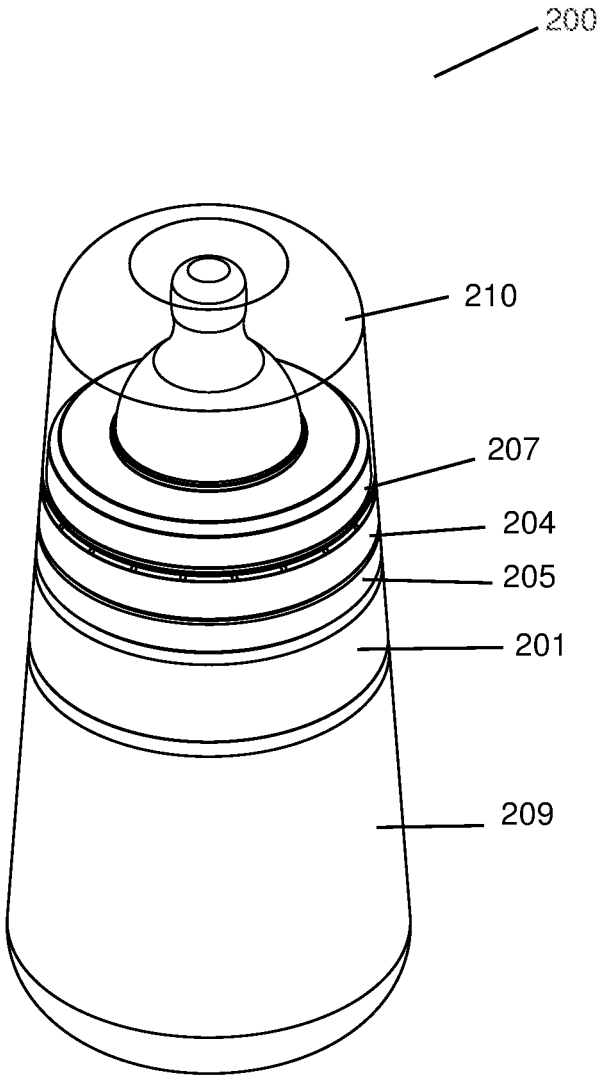
FIG. 5 is an isometric view of the assembly for dispensing a substance into the receptacle according to a second embodiment of the present invention.
Figure 6:
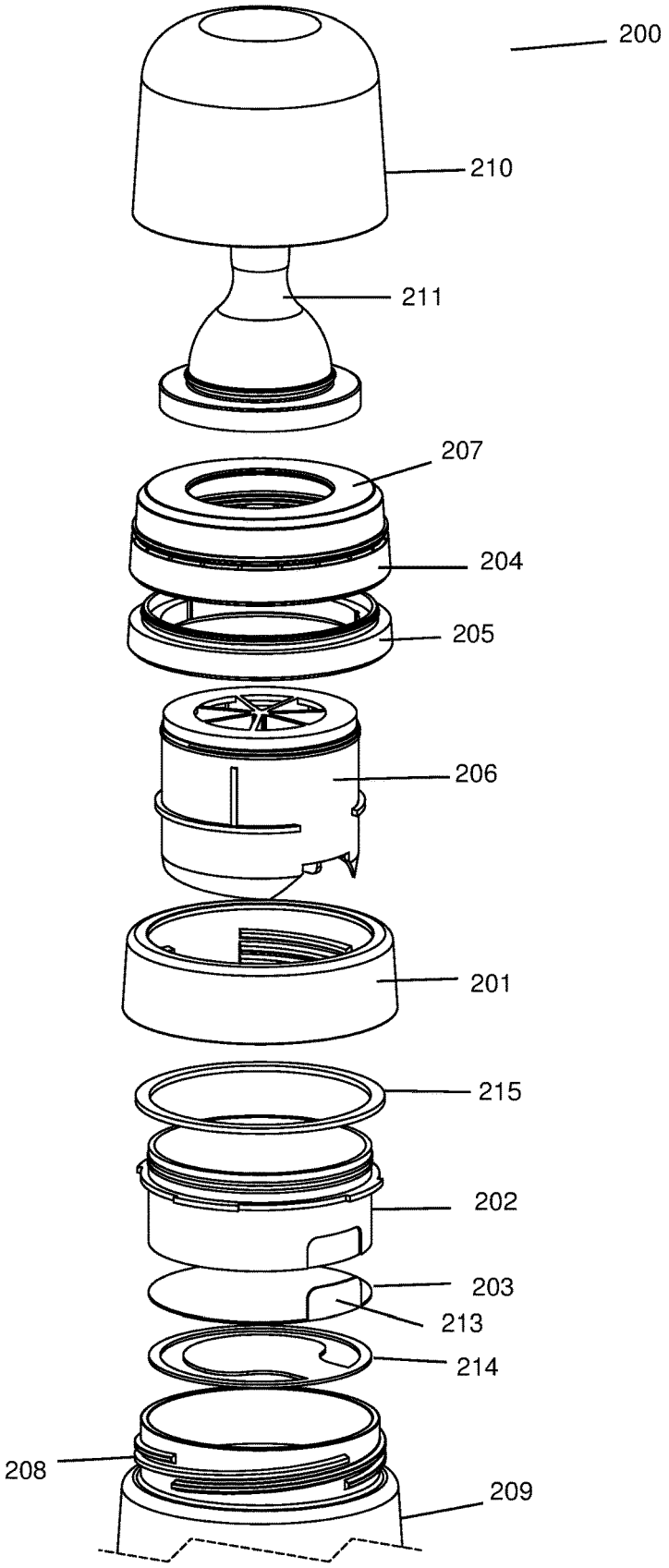
FIG. 6 is an exploded view of the assembly as shown in FIG. 5.
Figure 7:
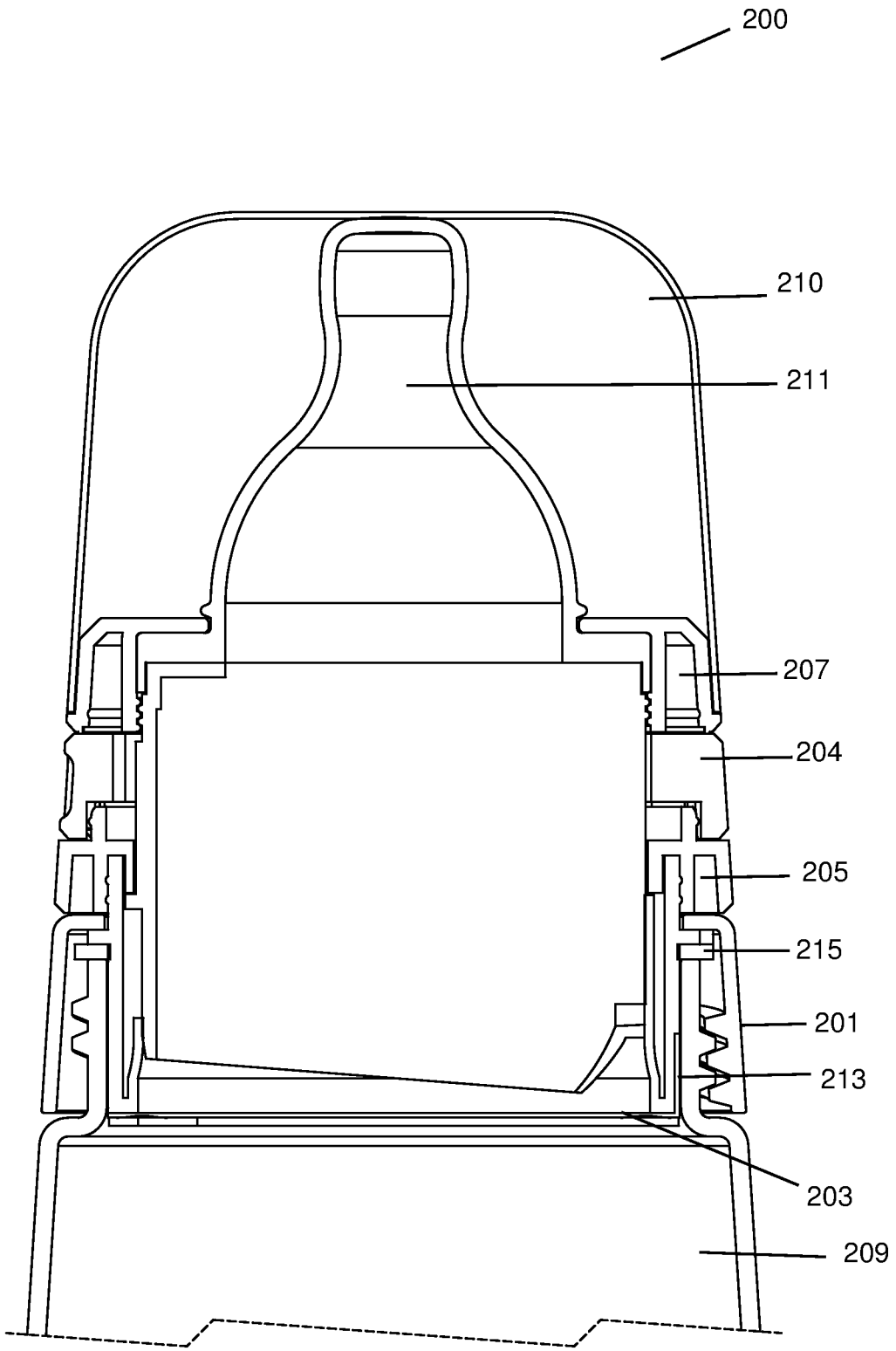
FIG. 7 is a frontal cross-sectional view of FIG. 5 showing the assembly in the configuration before the baby formula is released into the bottle.
Figure 8:
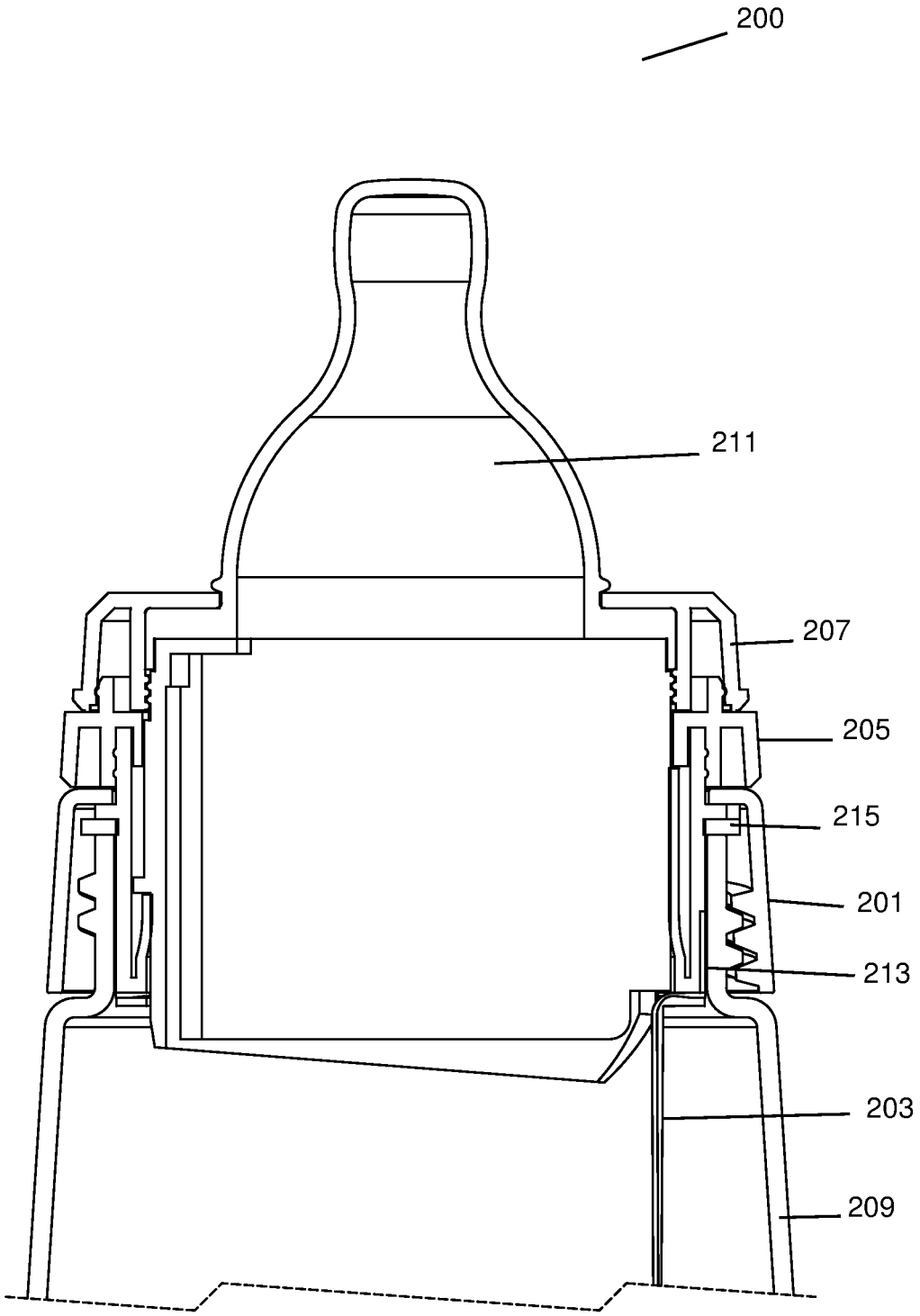
FIG. 8 is a frontal cross-sectional view of FIG. 5 showing the assembly in the configuration after the baby formula is released into the bottle.

As illustrated in FIGS. 5 and 6, the assembly 200 is comprised of a number of components including a first portion 201, a chamber 202, a seal 203, a second portion 205 located above the first portion 201, a chamber cutter 206, a removable member 204, a third portion 207 that is detachably coupled to the removable member 204, a mouth portion 211 such as a teat or a nipple. In this embodiment, the first portion 201 has internal threads which are configured to connect with the external threads 208 of the receptacle 209. A flange is formed at the top of the first portion 201 to support the second portion 205 (as shown in FIG. 7). As shown in FIGS. 6 to 8, the second portion 205 is attached to a portion of the chamber 202 and the first portion 201. Prior to the release of the baby formula, the second portion 205 is also attached to a removable member 204. As illustrated in FIG. 7, the removable member is coupled to a third portion 207. The third portion comprises a mouth portion 211 such as a teat.

A chamber cutter 206 is also located partially within the first portion 201 and chamber 202. On one end of the chamber cutter 206, a slant in a downward direction is provided which is configured to come into contact with a portion of the seal 203. It is envisioned that the chamber cutter 206 may be adapted to include different shapes and/or configurations. The chamber cutter is provided to cut or open the seal, to thereby open the chamber and allow the contents of the chamber to be delivered to the receptacle. The chamber cutter 206 may also include a spoke for structural integrity and support. In a preferred embodiment, the seal 203 will have a tab 213 that is located between a wall of the receptacle 209 and the first portion 201. The tab 213 is permanently fixed between the wall of the receptacle and the first portion thereby allowing only a portion of the seal 203 to fall into the receptacle as the chamber cutter pierces the seal 203. The seal 203 may be made of a plastic or foil material.

Figure 10:
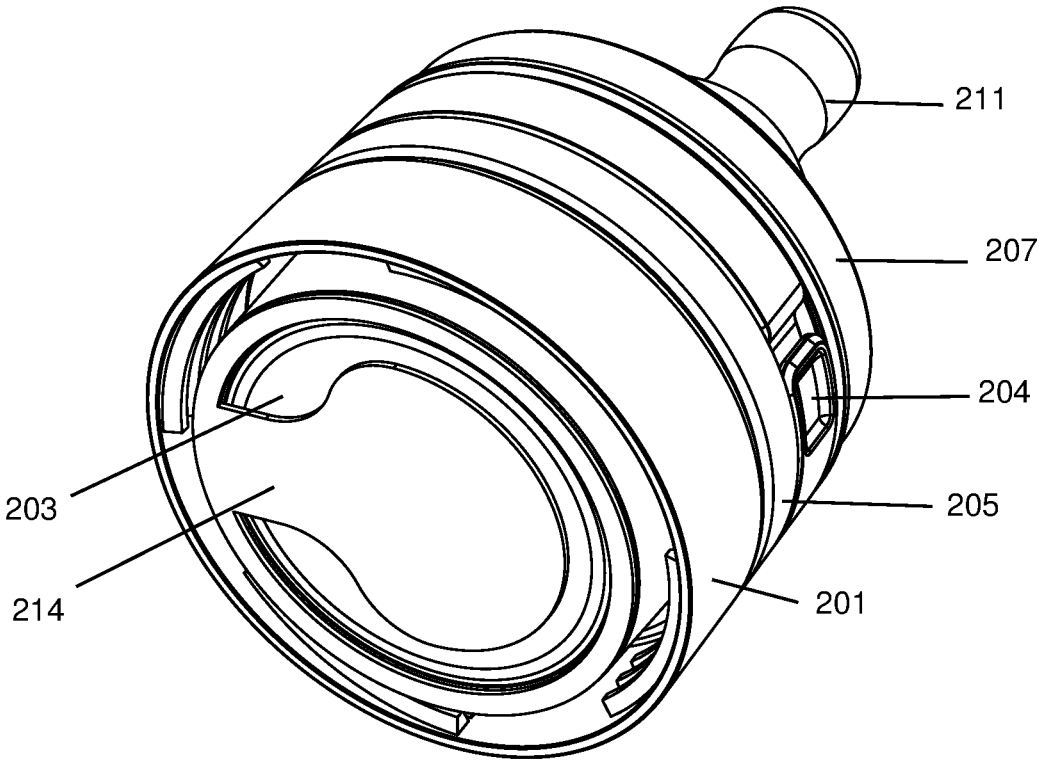
FIG. 10 is a bottom perspective view of FIG. 5 showing the assembly in the configuration before the baby formula is released into the bottle.
Figure 11:
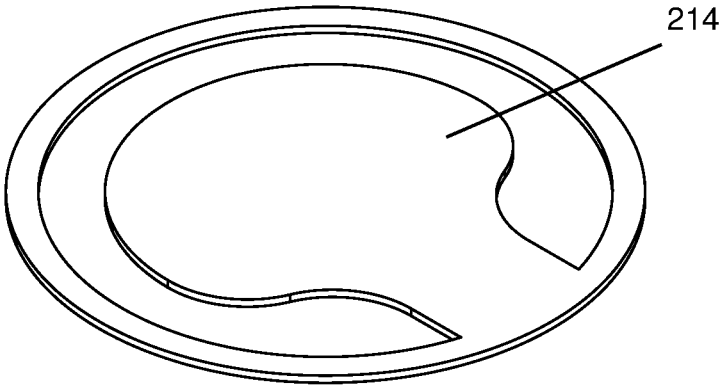
FIG. 11 is a perspective view of a disc in accordance with the second embodiment.

FIG. 10 shows a bottom perspective view of the seal 203. In a preferred embodiment, the seal 203 will further include a disc or displacer 214. The disc 214 may be connected to a portion of the first portion 201 and/or chamber 202. The disc 214 may also be attached to the seal 203 and is configured to partially fall into the receptacle 209 together with the seal 203 when the seal is broken to release the substance. The disc 214 acts as a stiffener and prevents the seal 203 from curling when it is inside the receptacle. The disc 214 may be made of a plastic material.

Similar to the previous embodiment described above, the chamber 202 has a circular ring 215 disposed on a flange of the chamber to prevent spillage or leakage of the liquid in the receptacle 209.

Figure 9:
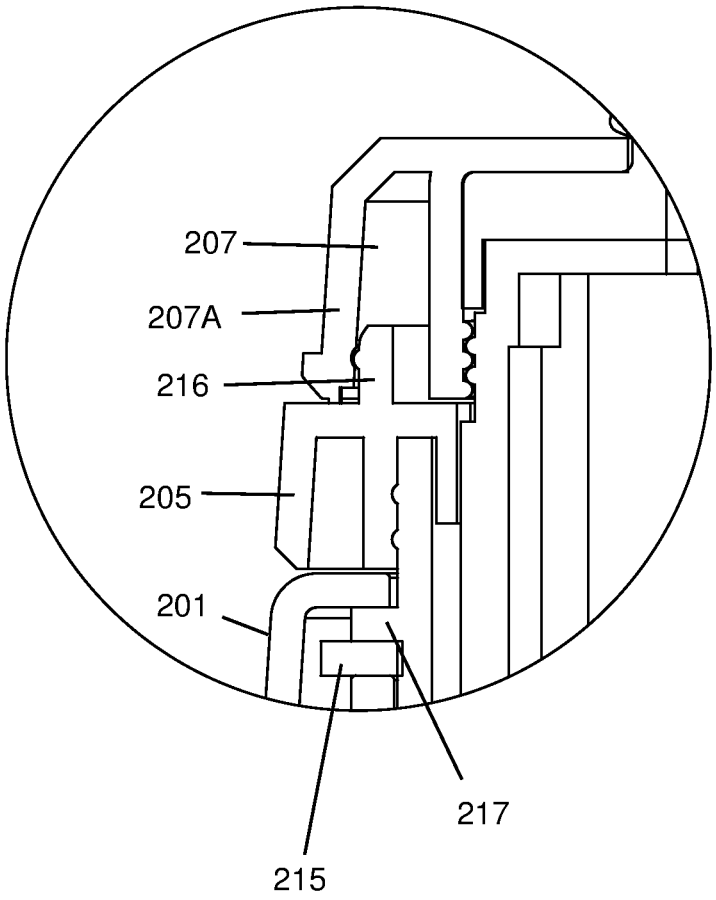
FIG. 9 is an enlarged view of a portion of the assembly as shown in FIG. 5.

In operation of the second embodiment, the removable member 204 will be removed from the assembly 200. A user will then push the third portion onto the second portion 205 in a downwards direction. In this configuration, the action of pushing the third portion onto the second portion will cause the chamber cutter to be moved downwards, thereby pushing the seal 203 and releasing the substance into the receptacle 209. Once the third portion is pushed and lowered onto the second portion 205, the third portion 207 is permanently mounted onto the second portion 205. This would prevent any movement between the components of the assembly 200. The locking mechanism is shown in FIG. 9 where attachment means may be provided on each of the third portion 207, the second portion 205 and the chamber 202 to secure each of the components together once the substance has been released into the receptacle 209. For example, a vertical lip 216 may be present on the top of the second portion 205. The vertical lip 216 is configured to lock with a portion of the third portion 207 to prevent movement between the second portion and the third portion. In the embodiment shown in FIG. 9, a lateral projection on vertical lip 216 fits into a complementary shaped recess in a downwardly extending part 207A of third portion 207. A lateral shoulder 217 may be provided on the chamber 202 to prevent movement between the chamber 202 and first portion 201.

Similar to the previous embodiment, once the substance from the chamber 202 is released into the receptacle, the user will then mix the substance (e.g. infant formula powder) with the substance inside the receptacle (e.g. water) until both substances are combined. The user will the proceed to remove the protective lid 210 to feed the infant formula to the baby. If desired, the user can microwave or warm the substance in the receptacle to an appropriate temperature before feeding the baby.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. An assembly for dispensing a substance into a receptacle, the assembly comprising:

a) a first portion connected to an opening of the receptacle;

b) a second portion located above the first portion;

c) a chamber for containing the substance, the chamber being at least partially located within the first portion;

d) a seal located below the chamber, the seal retaining the substance in the chamber;

e) a chamber cutter, the chamber cutter being at least partially located within the first portion and second portion;

f) a third portion located above the second portion, g) a removable stop member, the second portion being adapted to support the removable stop member prior to the release of the substance, and the third portion after the release of the substance; and wherein removal of the stop member enables the third portion to be moved downwardly which causes the chamber to be moved downwardly to cause the seal to open and release the substance into the receptacle, wherein the seal further includes a tab extending upwardly and resting between a wall of the receptacle and the first portion and wherein the assembly further includes:

h) a recess in a downwardly extending part of the third portion, and i) a lateral projection on a vertical lip on the top of the second portion, wherein the recess is shaped complementary to the shape of the lateral projection, wherein the lateral projection on the vertical lip fits into the complementary shaped recess in the downwardly extending part when the third portion is pushed and lowered onto the second portion which locks the third portion to prevent movement between the second portion and the third portion once the substance has been released into the receptacle.

2. The assembly according to claim 1, wherein the first portion comprises a flange to support the second portion.

3. The assembly according to claim 1, wherein the third portion is located above the removable stop member.

4. The assembly according to claim 3, wherein the third portion connects to a mouth portion or a teat.

5. The assembly according to claim 1, wherein the chamber cutter includes a spoke for structural support.

6. The assembly according to claim 1, wherein one end of the chamber cutter is slanted in a downward direction and configured to come in contact with a portion of the seal.

7. The assembly according to claim 1, wherein the seal comprises a circular seal made of plastic or foil material and the seal rests between the chamber and the first portion and the seal further includes the tab resting between a wall of the receptacle and the first portion.

8. The assembly according to claim 1, wherein the chamber further includes a lateral shoulder to engage with the first portion.

9. The assembly according to claim 4, further comprising a lid to protect the mouth portion.

10. The assembly according to claim 1, wherein the assembly further comprises a disc located below the seal, the disc acting as a stiffener for the seal.

11. The assembly as claimed in claim 10, wherein the disc comprises an annular ring supporting a central disc, the central disc connected to the annular ring by a connecting portion.

* * * * *